US010916852B2

(12) United States Patent
Chou et al.

(10) Patent No.: US 10,916,852 B2
(45) Date of Patent: Feb. 9, 2021

(54) ANTENNA DEVICE CAPABLE OF GENERATING SPECIFIC RADIATION PATTERN

(71) Applicant: UNICTRON TECHNOLOGIES CORPORATION, Hsin-Chu (TW)

(72) Inventors: Chih-Shen Chou, Hsin-Chu (TW); Tsung-Shou Yeh, Hsin-Chu (TW); Hsiang-Cheng Yang, Hsin-Chu (TW); Hung-Yi Chang, Hsin-Chu (TW)

(73) Assignee: Unictron Technologies Corporation, Hsin-Chu (TW)

( * ) Notice: Subject to any disclaimer, the term of this patent is extended or adjusted under 35 U.S.C. 154(b) by 57 days.

(21) Appl. No.: 16/104,247

(22) Filed: Aug. 17, 2018

(65) Prior Publication Data

US 2019/0058255 A1 Feb. 21, 2019

(30) Foreign Application Priority Data

Aug. 18, 2017 (CN) ..... 2017 2 1037890 U

(51) Int. Cl.

| | |
|---|---|
| ***H01Q 1/38*** | (2006.01) |
| ***H01Q 9/04*** | (2006.01) |
| ***H01Q 1/48*** | (2006.01) |
| ***H01Q 5/321*** | (2015.01) |
| ***H01Q 9/42*** | (2006.01) |

(52) U.S. Cl.

CPC ..... *H01Q 9/0421* (2013.01); *H01Q 1/38* (2013.01); *H01Q 1/48* (2013.01); *H01Q 5/321* (2015.01); *H01Q 9/0414* (2013.01); *H01Q 9/42* (2013.01)

(58) Field of Classification Search

CPC ..... H01Q 9/04; H01Q 5/30–5/321; H01Q 7/06–7/08; H01Q 1/24–1/38

See application file for complete search history.

(56) References Cited

U.S. PATENT DOCUMENTS

| | | | | |
|---|---|---|---|---|
| 6,288,680 | B1 * | 9/2001 | Tsuru | H01Q 1/243 343/700 MS |
| 6,707,427 | B2 * | 3/2004 | Konishi | H01Q 1/243 343/700 MS |
| 7,079,079 | B2 * | 7/2006 | Jo | H01Q 1/243 343/700 MS |
| 7,714,786 | B2 * | 5/2010 | Chen | H01Q 9/0421 343/700 MS |

(Continued)

*Primary Examiner* — Hasan Z Islam

(74) *Attorney, Agent, or Firm* — Winston Hsu

(57) ABSTRACT

An antenna device includes a circuit board and at least one chip antenna. The circuit board includes a clearance area and at least one signal feeding line disposed in the clearance area. The chip antenna includes a substrate and at least one resonance unit partially or wholly disposed on the surface of or within the substrate. The chip antenna is disposed in the clearance area of the circuit board and the resonance unit of the chip antenna is connected to the signal feeding line. A shortest distance from an edge of the clearance area to a nearest edge of the circuit board is greater than 1/10 of a smallest width of the circuit board. Therefore, the polarization direction of the chip antenna is approximately perpendicular to the upper surface of the circuit board, as well as the direction of the strongest signal strength of the radiation pattern is approximately parallel to the upper surface of the circuit board.

3 Claims, 10 Drawing Sheets

(56) References Cited

U.S. PATENT DOCUMENTS

| | | | | |
|---|---|---|---|---|
| 2005/0078038 | A1* | 4/2005 | Takaki | H01Q 1/243 343/702 |
| 2008/0079642 | A1* | 4/2008 | Ishizuka | H01Q 1/243 343/702 |
| 2017/0093043 | A1* | 3/2017 | Chou | H05K 1/144 |
| 2018/0090839 | A1* | 3/2018 | Chou | H01Q 1/52 |

* cited by examiner

ANTENNA DEVICE CAPABLE OF GENERATING SPECIFIC RADIATION PATTERN

REFERENCE TO RELATED APPLICATIONS

This non-provisional application claims priority claim under 35 U.S.C. § 119(a) on China Patent Application No. 201721037890.9 filed Aug. 18, 2017, the entire contents of which are incorporated herein by reference.

FIELD OF THE INVENTION

The present invention relates to an antenna device, and more particularly to an antenna device capable of generating specific radiation pattern.

BACKGROUND

With the advancement of wireless communication technologies, wireless communication products are widely used in our daily lives, and one of the most important components of wireless communication products is the antenna device. Among different types of antenna devices, microstrip antenna has advantages including having a planar profile, being mass produced, and easy integration on circuit boards. Thus microstrip antennas have been widely used in many portable devices like mobile phones, smart phones, tablet computers, notebook computers, global positioning systems (GPS), or radio frequency identification devices (RFID).

One of the ways to reduce the size and weight of portable devices is to reduce the space required for antenna, and planar inverted F antenna (PIFA) is a microstrip antenna that is often used as the built-in antenna for a portable device.

However, the direction of the strongest signal strength of the radiation pattern of the PIFA antenna depends on the shape or dimensions of ground plane, which may not be the desirable antenna radiation pattern for the portable device, and this issue cannot be easily resolved by adjusting the antenna shape or layout.

SUMMARY

An object of the present invention is to provide an antenna device capable of generating specific radiation pattern, in which a chip antenna is disposed in a clearance area of a circuit board, and the shortest distance from an edge of the clearance area to the nearest edge of the circuit board is greater than one tenth (1/10) of the smallest width of the circuit board, thereby achieving the polarization direction of the antenna device to be approximately perpendicular to the upper surface of the circuit board and the radiation pattern of the antenna device to have the direction of the strongest signal strength be approximately parallel to the upper surface of the circuit board.

Another object of the present invention is to provide an antenna device capable of generating specific radiation pattern, in which a chip antenna is disposed in a clearance area of a circuit board and a first ground layer is disposed on the circuit board around the clearance area and is separated from a second ground layer of the circuit board by an isolation area, wherein the isolation area is a region with no metal layer. Through the above-mentioned design, the chip antenna, the clearance area, and the first ground layer may be positioned anywhere on the circuit board and yet the antenna device still has its polarization direction approximately perpendicular to the upper surface of the circuit board and has its radiation pattern with the strongest signal strength direction approximately parallel to the upper surface of the circuit board.

According to an embodiment of the present invention, an antenna device capable of generating specific radiation pattern includes a circuit board and at least one chip antenna. The circuit board includes a clearance area and at least one signal feeding line disposed in the clearance area. The shortest distance from an edge of the clearance area to the nearest edge of the circuit board is greater than 1/10 of the smallest width of the circuit board. The at least one chip antenna includes a substrate and at least one resonance unit. The at least one resonance unit is comprised of conductive traces or conductive layers formed by conductive material and is partially or wholly disposed on the surface of or within the substrate. The at least one chip antenna is disposed in the clearance area of the circuit board, and the at least one resonance unit is connected to the at least one signal feeding line.

According to another embodiment of the present invention, an antenna device capable of generating specific radiation pattern includes a circuit board and at least one chip antenna. The circuit board includes a clearance area, at least one signal feeding line, a first ground layer, and a second ground layer. The first ground layer is disposed at the perimeter of the clearance area, and an isolation area is formed between the first ground layer and the second ground layer, wherein the isolation area is a region with no metal layer. The at least one chip antenna includes a substrate and at least one resonance unit partially or wholly disposed on the surface of or within the substrate. The at least one chip antenna is disposed in the clearance area and the at least one resonance unit is connected to the at least one signal feeding line.

BRIEF DESCRIPTION OF THE DRAWINGS

The structure as well as preferred modes of use, further objects, and advantages of this invention will be best understood by referring to the following detailed description of some illustrative embodiments in conjunction with the accompanying drawings, in which.

DETAILED DESCRIPTION OF THE PREFERRED EMBODIMENTS

Figure 1:
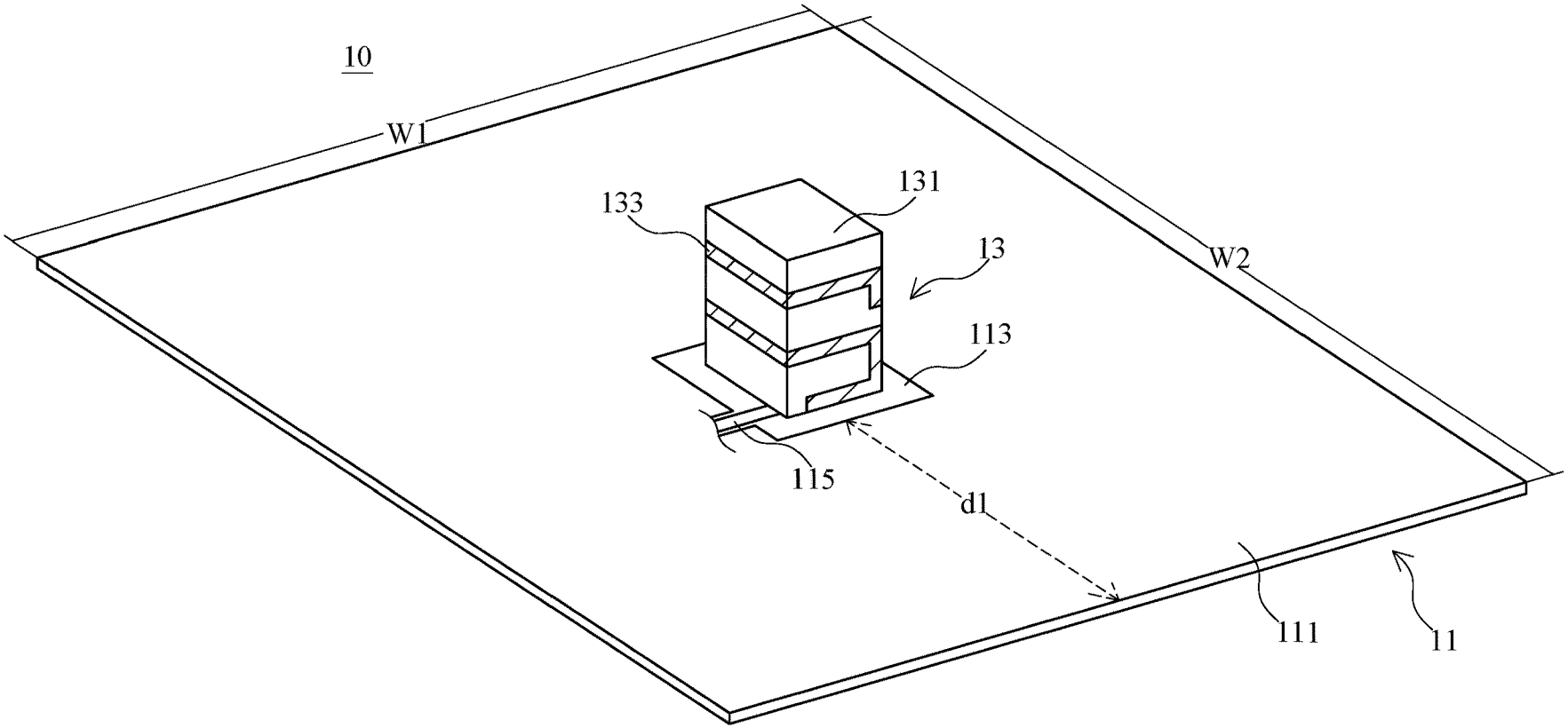
FIG. 1 is a perspective view of an antenna device capable of generating specific radiation pattern according to a first embodiment of the invention.
Figure 2:
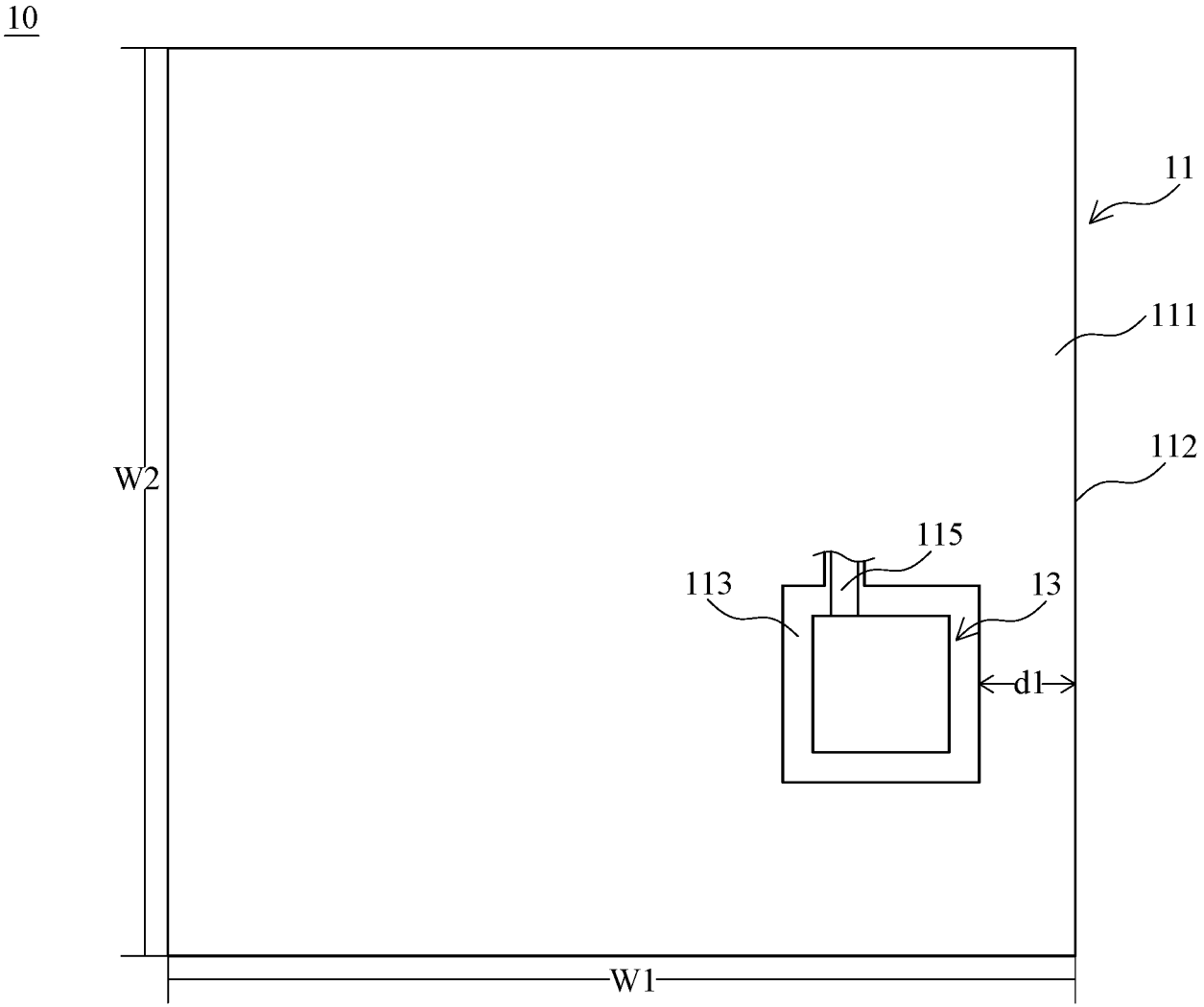
FIG. 2 is a top view of the antenna device capable of generating specific radiation pattern according to the first embodiment of the invention.
Figure 3:
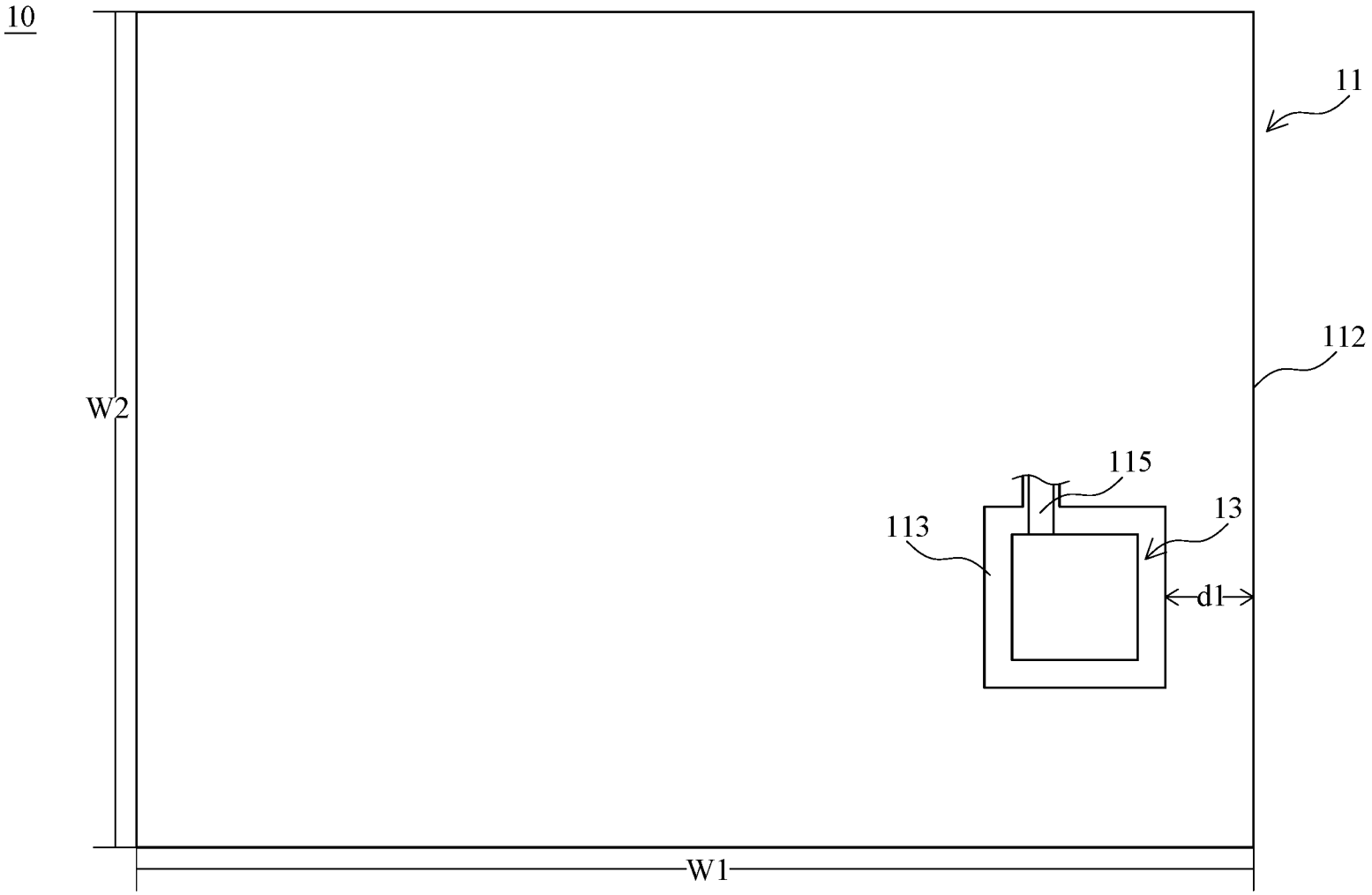
FIG. 3 is a top view of the antenna device capable of generating specific radiation pattern according to the first embodiment of the invention.
Figure 4:
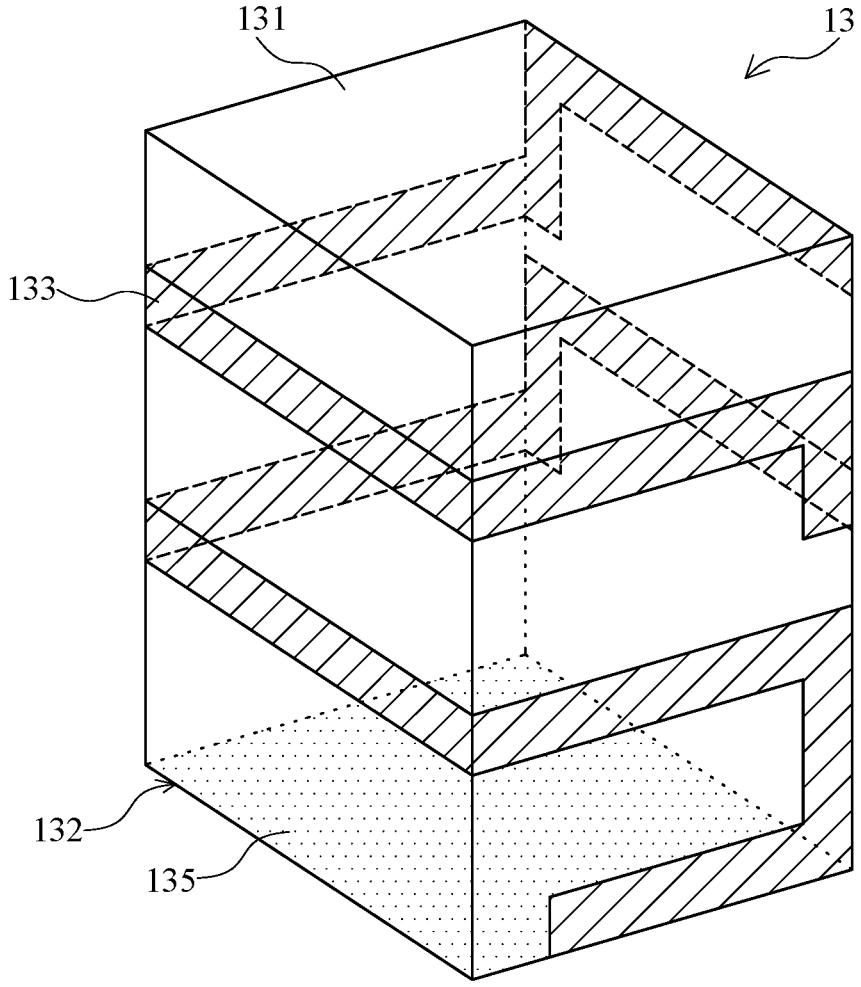
FIG. 4 is a perspective view of a chip antenna of the antenna device according to an embodiment of the invention.
Figure 5:
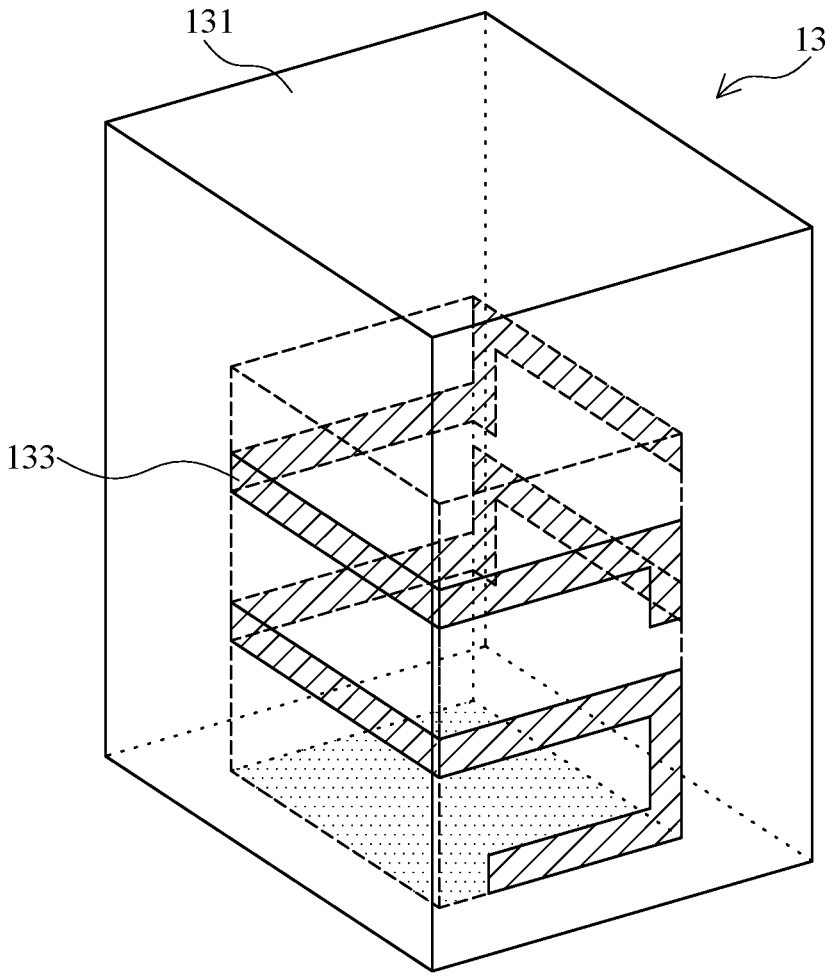
FIG. 5 is a perspective view of a chip antenna of the antenna device according to another embodiment of the invention.

FIG. 1 is a perspective view of an antenna device capable of generating specific radiation pattern according to a first embodiment of the present invention. FIG.2 and FIG. 3 are top views of the antenna device according to the first embodiment of the present invention. FIG. 4 and FIG. 5 are perspective views of a chip antenna of the antenna device according to embodiments of the present invention.

As shown in FIG. 1 and FIG. 2, the antenna device 10 includes a circuit board 11 and a chip antenna 13. The circuit board 11 includes a clearance area 113 and at least one signal feeding line 115. The chip antenna 13 is disposed in the clearance area 113 and includes a substrate 131 and at least one resonance unit 133.

In this embodiment, a shortest distance d1 from an edge of the clearance area 113 to an edge of the circuit board 11 nearest thereto is greater than 1/10 of the circuit board's smallest width (W1 or W2). The clearance area 113 is located on an upper surface 111 of the circuit board 11 and confines a range where the chip antenna 13 and the signal feeding line 115 may be disposed. When the chip antenna 13 and the signal feeding line 115 are both disposed in the clearance area 113 of the circuit board 11, the polarization direction of the antenna device 10 is approximately perpendicular to the upper surface 111 of the circuit board 11, and thereby the strongest signal strength direction of the radiation pattern of the antenna device 10 is approximately parallel to the upper surface 111 of the circuit board 11.

The relation between the width of the circuit board 11 and the distance from the edge of the clearance area 113 to the edge 112 of the circuit board 11 plays a major influence on the characteristics and functions of the antenna device 10, and thus the ratio between the two must be a specific ratio. In general, if the chip antenna 13 is disposed directly adjacent to the edge 112 of the circuit board 11, the antenna device 10 would not be able to generate the radiation pattern where the direction of the strongest signal strength is parallel to the upper surface 111 of the circuit board 11. Hence the inventors concluded from extensive research that a region non-adjacent to the edge 112 of the circuit board 11 shall be defined as a region suitable for the clearance area 113 to be located in. More specifically, as shown in FIG. 2, the shortest distance d1 from an edge of the clearance area 113 to the nearest edge 112 of the circuit board 11 is set to be greater than 1/10 of the smallest width of the circuit board 11.

By disposing the chip antenna 13 and the signal feeding line 115 in the clearance area 113, the antenna device 10 generates a radiation pattern having the direction of the strongest signal strength approximately parallel to the upper surface 111 of the circuit board 11.

In one embodiment of the invention, the circuit board 11 is a square with four equal sides and has a first width W1 and a second width W2, as shown in FIG. 1 and FIG. 2. The first width W1 and the second width W2 are the same length and are both the smallest width of the circuit board 11. Accordingly, a distance d1 from the edge of the clearance area 113 to the edge 112 of the circuit board 11 that is closest to the edge of the clearance area 113 is greater than 1/10 of the first width W1 and 1/10 of the second width W2.

In another embodiment of the invention, the circuit board 11 is rectangular and has a first width W1 and a second width W2, wherein the second width W2 is smaller than the first width W1, as shown in FIG. 3. Therefore, the second width W2 is the narrowest/smallest width of the circuit board 11, and so the distance d1 from the edge of the clearance area 113 to the nearest edge 112 of the circuit board 11 must be larger than 1/10 of the second width W2.

It is noted that the above-mentioned square or rectangular circuit board 11 is merely an embodiment of the invention, and the scope of the invention is not limited thereby. In actual implementation, the circuit board 11 may be other geometric shapes, like polygons, or any other shape, and the region for the clearance area 113 to be located in can still be defined on the circuit board 11 by applying the rule of having the shortest distance d1 from an edge of the clearance area 113 to the nearest edge of the circuit board 11 be greater than 1/10 of the smallest width of the circuit board 11.

Moreover, if the chip antenna 13 is disposed near the central region of the circuit board 11, the strongest signal strength direction of the radiation pattern of the antenna device 10 would be approaching to be parallel to the upper surface 111 of the circuit board 11.

The chip antenna 13 includes the substrate 131 and the resonance unit 133, wherein the resonance unit 133 connects to the signal feeding line 115 and is comprised of conductive traces or conductive layers formed by conductive material.

In one embodiment of the present invention, the resonance unit 133 is partially or wholly disposed on the surface of the substrate 131, as shown in FIG. 4. In particular, the substrate 131 of the chip antenna 13 is a three-dimensional structure such as cuboids, cubes, polygonal prisms, or cylinders. The substrate 131 in FIG. 4 is a cuboid, wherein a bottom surface 132 of the substrate 131 is disposed on the upper surface of the clearance area 113 of the circuit board 11, and the resonance unit 133 is disposed on surface of the substrate 131 other than the bottom surface 132.

In another embodiment of the present invention, the resonance unit 133 may be partially or wholly disposed within the substrate 131, as shown in FIG. 5. As mentioned before, a main feature of the present invention is the chip antenna 13 being disposed in the clearance area 113 of the circuit board 11 for the purpose of making the polarization direction of the antenna device 10 approximately perpendicular to the upper surface 111 of the circuit board 11 and making the radiation pattern have the direction of the strongest signal strength approximately parallel to the upper surface 111 of the circuit board 11, wherein the upper surface 111 of the circuit board 11 is the surface on which the chip antenna 13 is disposed. Hence in actual implementation, the above-mentioned purpose can be achieved despite the resonance unit 133 being disposed partially or wholly on the surface of or within the substrate 131.

In addition, the chip antenna further includes a conducting layer 135 disposed on the bottom surface 132 of the substrate 131, wherein the chip antenna 13 is disposed in the clearance area 113 via the conducting layer 135. The conducting layer 135 also connects the resonance unit 133 and the signal feeding line 115. For example, the signal feeding line 115 is connected to a soldering pad located within the clearance area 113, and the conducting layer 135 which is connected with the resonance unit 133 is connected with the above mentioned soldering pad through soldering and reflow processes.

Nevertheless, the conducting layer 135 is not an essential component of the present invention. In a different embodiment, no conducting layer 135 was disposed in the chip antenna 13. The chip antenna 13 is disposed in the clearance area 113 of the circuit board 11 directly via its bottom surface, and the resonance unit 133 of the chip antenna 13 connects directly to the signal feeding line 115.

Figure 6:
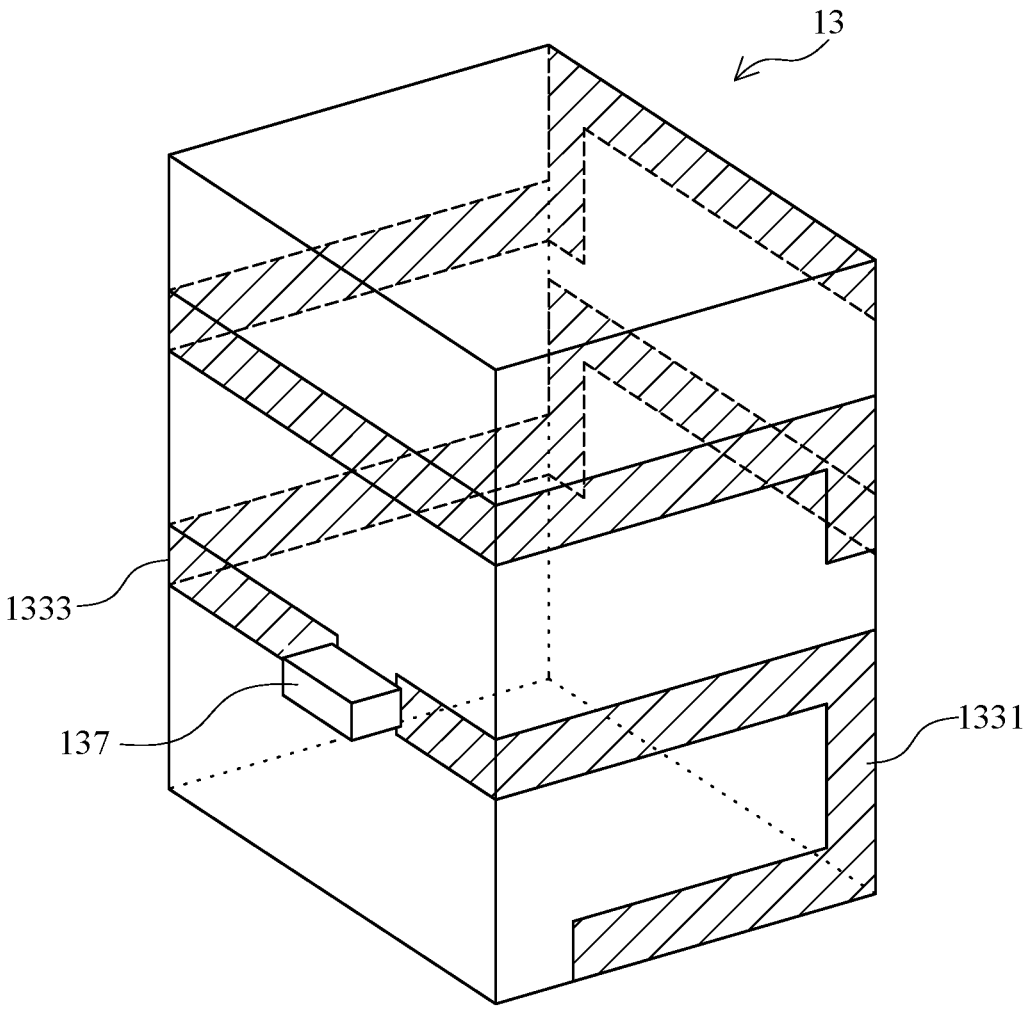
FIG. 6 is a perspective view of a chip antenna of the antenna device according to another embodiment of the invention.
Figure 7:
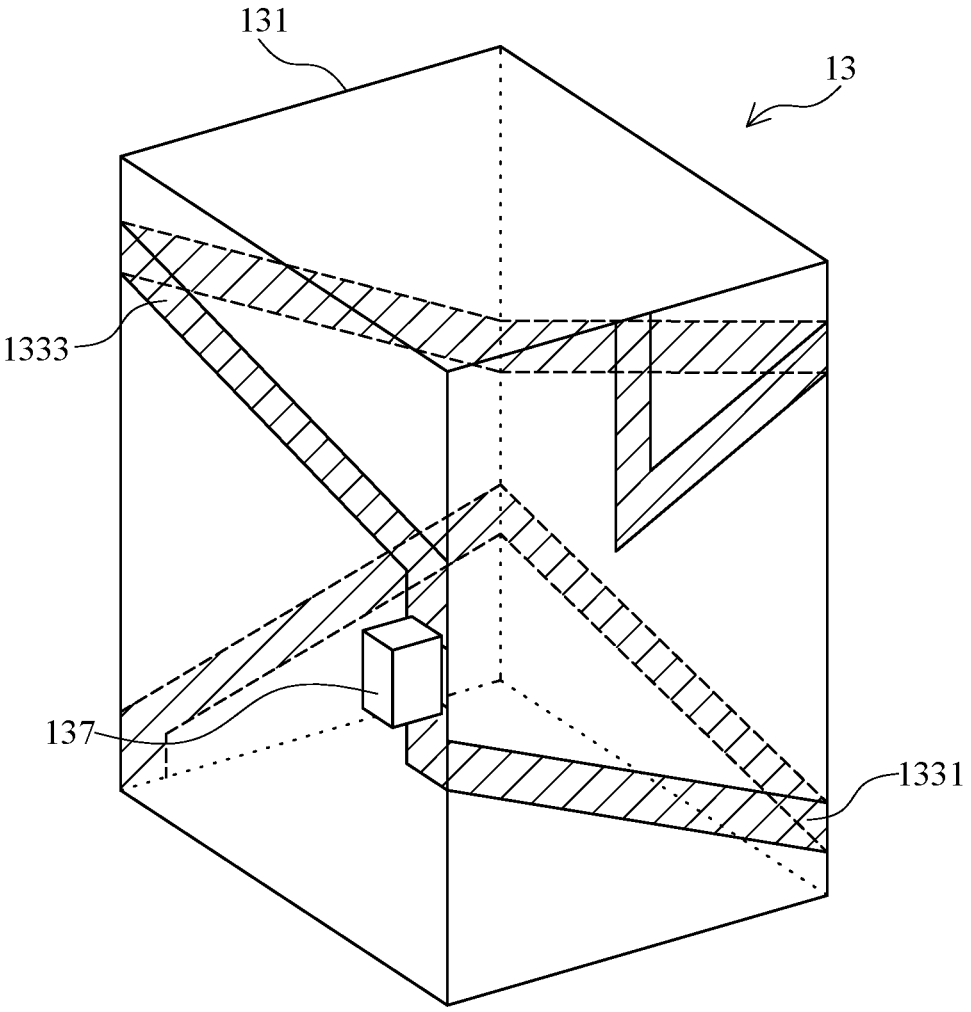
FIG. 7 is a perspective view of a chip antenna of the antenna device according to another embodiment of the invention.

In one embodiment of the present invention, the resonance unit 133 includes a first resonance element 1331 and a second resonance element 1333, wherein the first resonance element 1331 is connected to the second resonance element 1333 via a tuning element 137, as shown in FIG. 6 and FIG. 7. The tuning element 137 is used for tuning the resonant frequency of the chip antenna 13. The tuning element 137 includes at least one inductor, one capacitor, or one resistor.

In another embodiment of the present invention, the first resonance element 1331 of the chip antenna 13 generates a first resonant frequency f1. The tuning element 137 shows high impedance towards signals that have the first resonant frequency f1, thereby blocking the signals with first resonant frequency f1 from being transmitted to the second resonance element 1333. And, the first resonance element 1331, the tuning element 137, and the second resonance element 1333 together generate a second resonant frequency f2. The tuning element 137 shows low impedance towards signals that have the second resonant frequency f2, which allows the signals with second resonant frequency f2 to pass through the tuning element 137. Through the implementation of the tuning element 137, the antenna device 10 is able to generate two resonant frequencies. The tuning element 137 includes at least one inductor or a resonant circuit consisting of capacitors and inductors (LC resonant circuit).

Although the resonance unit 133 in FIGS. 4 to 7 is shown in two configurations, but they are merely embodiments of the present invention, the scope of the invention is not limited thereby. The configuration of the resonance unit 133 varies in different embodiments.

Figure 8:
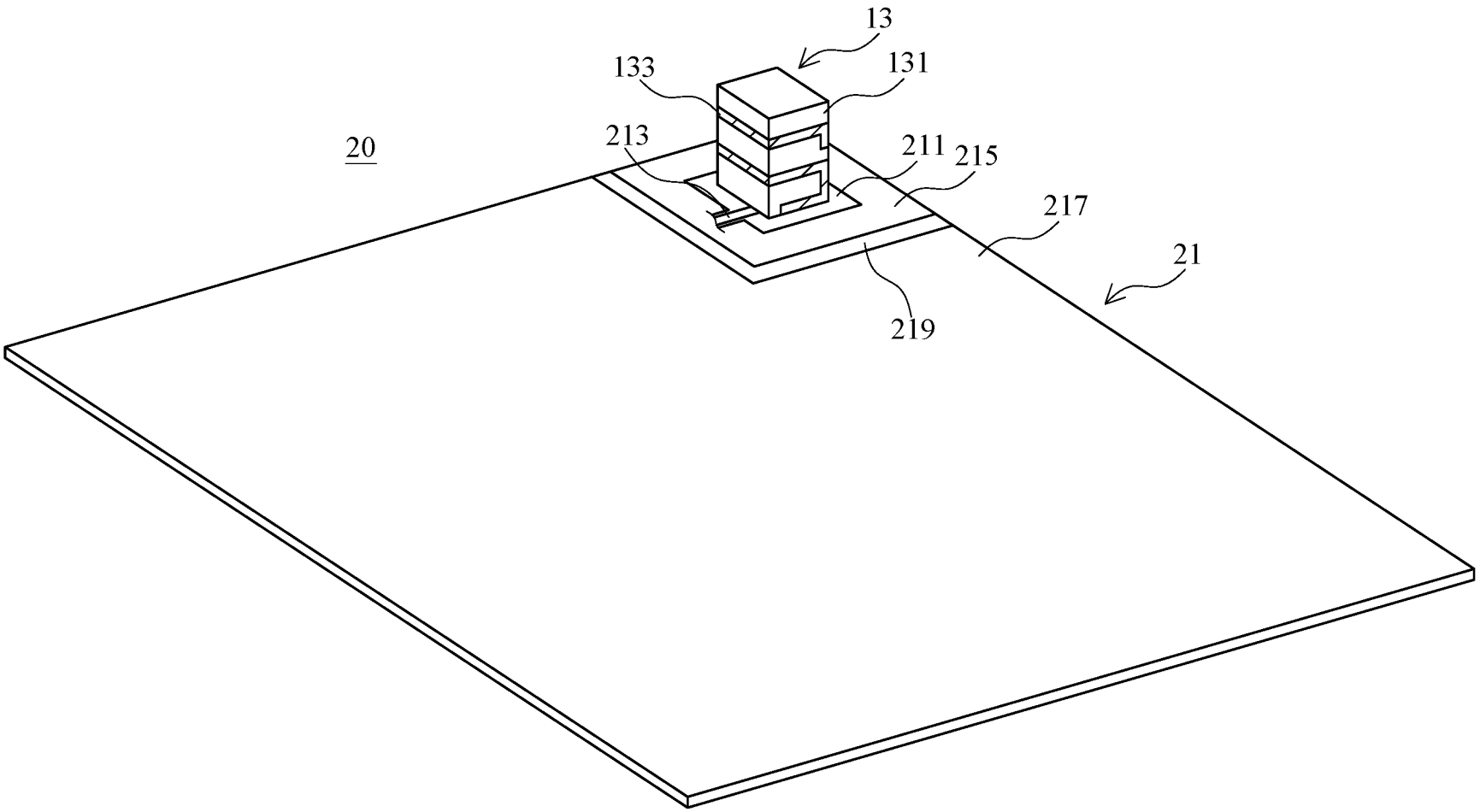
FIG. 8 is a perspective view of an antenna device capable of generating specific radiation pattern according to a second embodiment of the invention.

FIG. 8 is a perspective view of an antenna device capable of generating specific radiation pattern according to a second embodiment of the present invention. The antenna device 20 includes a circuit board 21 and a chip antenna 13. The circuit board 21 includes a clearance area 211, at least one signal feeding line 213, a first ground layer 215, an isolation area 219, and a second ground layer 217. The chip antenna 13 includes a substrate 131 and at least one resonance unit 133, wherein the chip antenna 13 is disposed in the clearance area 211 of the circuit board 21.

The first ground layer 215 of the circuit board 21 is disposed at the perimeter of the clearance area 211, and the isolation area 219 is formed between the second ground layer 217 and the first ground layer 215. In one embodiment of the invention, the first ground layer 215 is approximately square-shaped.

Figure 9:
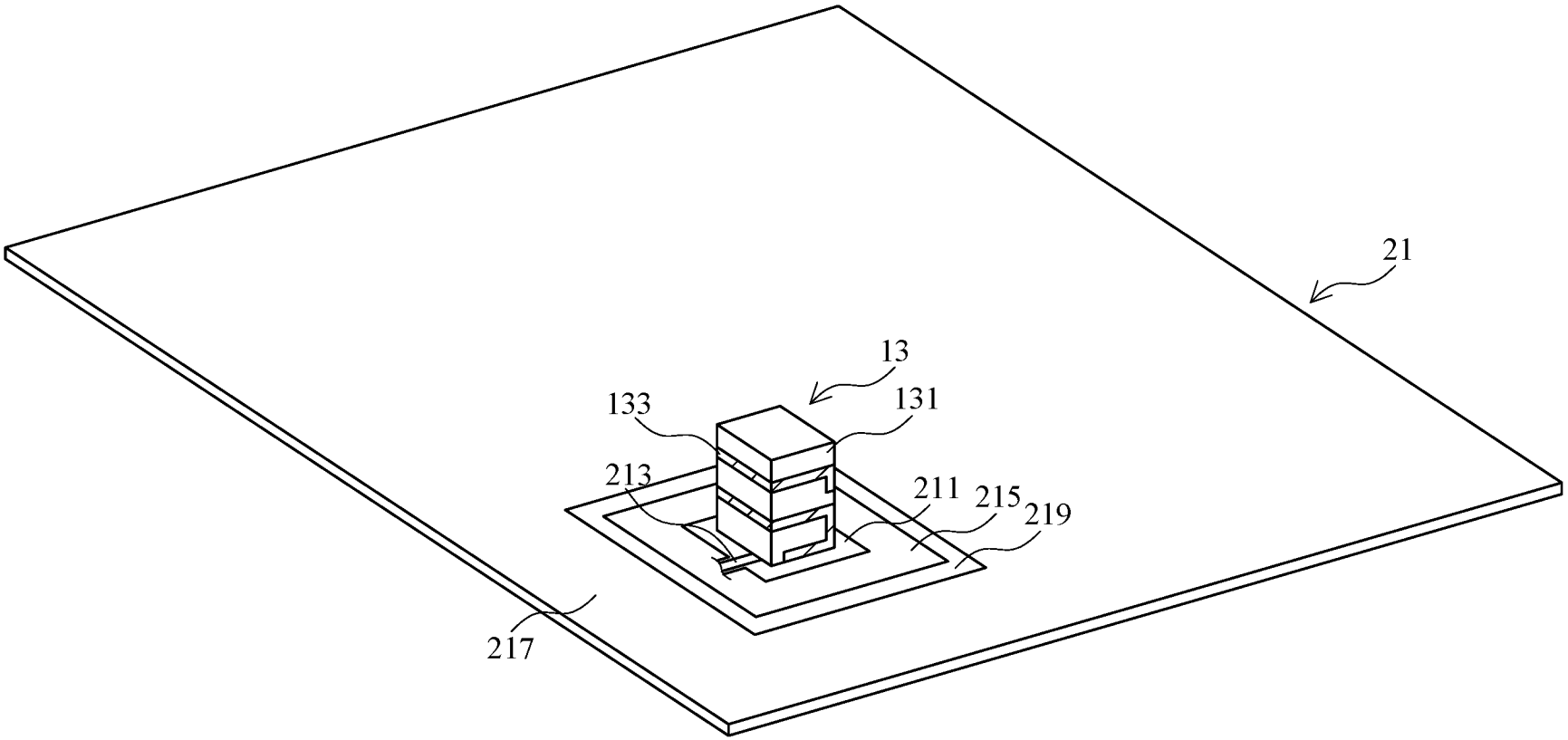
FIG. 9 is a perspective view of an antenna device capable of generating specific radiation pattern according to a third embodiment of the invention.

Since the isolation area 219 and the first ground layer 215 are positioned between the chip antenna 13 and the second ground layer 217 of the circuit board 21, the chip antenna 13, the clearance area 211, the first ground layer 215, and the isolation area 219 may be disposed at any location on the circuit board 21, even at the edge section of the circuit board 21. With such arrangement, the antenna device 20 can still obtain a polarization direction approximately perpendicular to the upper surface of the circuit board 21 and obtain a radiation pattern with the strongest signal strength direction approximately parallel to the upper surface of the circuit board 21. Referring to FIG. 8, the chip antenna 13, the clearance area 211, the first ground layer 215, and the isolation area 219 are disposed near the corner or the border of the circuit board 21. In different embodiments, the chip antenna 13, the clearance area 211, the first ground layer 215, and the isolation area 219 may be disposed in an internal region of the circuit board 21, away from the corner or the border of the circuit board 21, as shown in FIG. 9.

In particular, unlike the first embodiment of the present invention, the antenna device 20 of the second embodiment does not require a predefined region on the circuit board 11 that is suitable for the clearance area 113 and the chip antenna 13 to be located in, and yet the antenna device 20 is still able to achieve a polarization direction that is approximately perpendicular to the upper surface of the circuit board 21 and a radiation pattern having the direction of strongest signal strength approximately parallel to the upper surface of the circuit board 21.

The main feature of the second embodiment is having a first ground layer 215 disposed at the perimeter of the clearance area 211 and having an isolation area 219 formed between the first ground layer 215 and the second ground layer 217. As a result, the polarization direction of the antenna device 20 is approximately perpendicular to the upper surface of the circuit board 21, and the radiation pattern of the antenna device 20 has the direction of the strongest signal strength approximately parallel to the upper surface of the circuit board 21. Hence, the chip antenna 13, the clearance area 211, the first ground layer 215 and the isolation area 219 may be disposed in any region of the circuit board 21. In practical application, the disposition of the chip antenna 13 can further be adjusted base on the layout of other elements on the circuit board 21.

According to the embodiments of the present invention, the resonance unit 133 of the chip antenna 13 may be disposed on the surface of or within the substrate 131 as shown in FIG. 4 and FIG. 5. The chip antenna 13 may also include a conducting layer 135 disposed on the bottom surface 132 of the substrate 131 and use the conducting layer 135 to connect the resonance unit 133 to the signal feeding line 115 as shown in FIG. 4. Furthermore, the resonance unit 133 of the chip antenna 13 may include a first resonance element 1331 and a second resonance element 1333, wherein the two resonance elements are connected via a tuning element 137, as shown in FIG. 6 and FIG. 7. As such, the antenna device 20 may adjust the resonant frequency or generate two resonant frequencies by using the tuning element 137.

Figure 10:
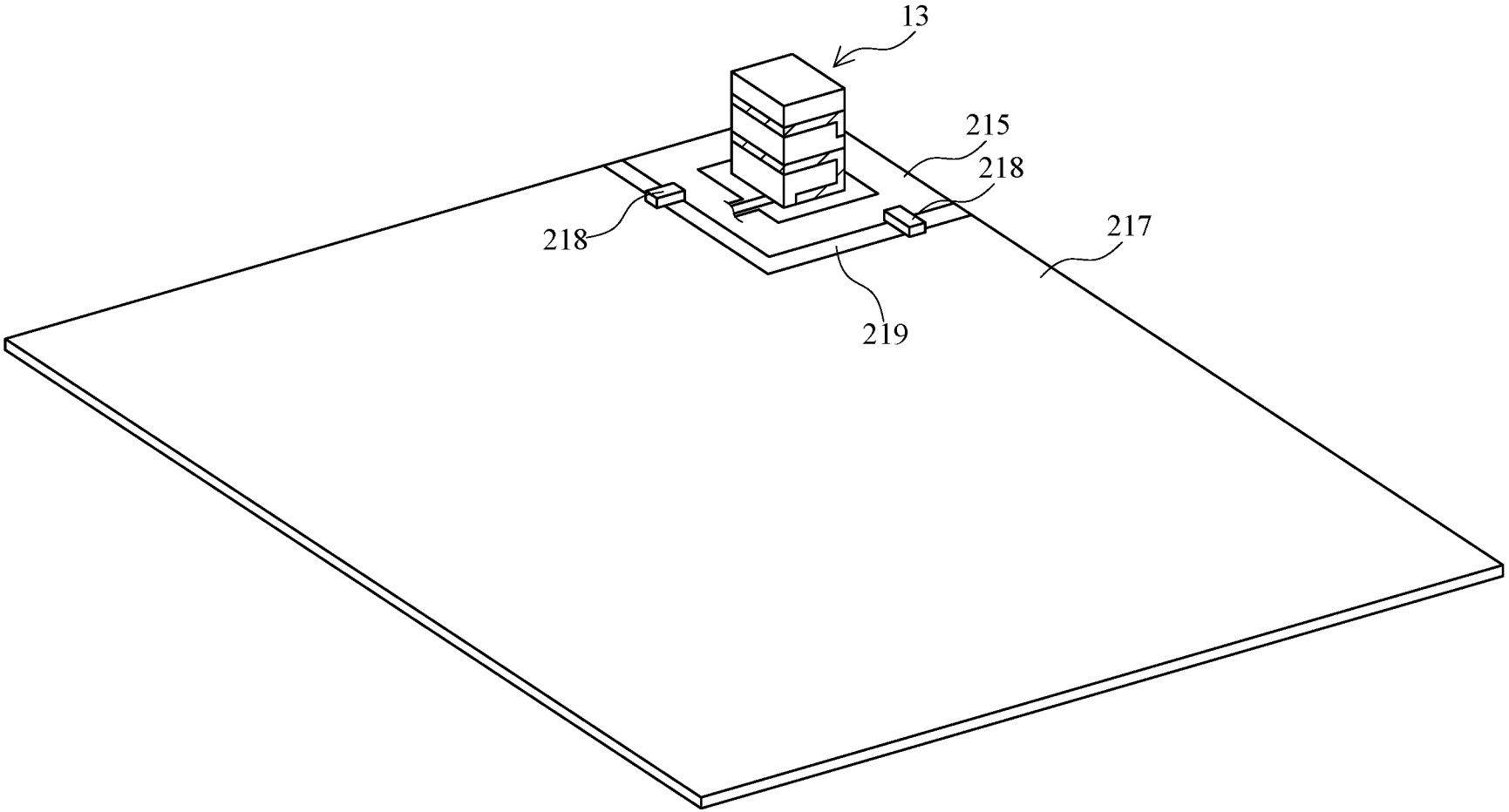
FIG. 10 is a perspective view of an antenna device capable of generating specific radiation pattern according to a fourth embodiment of the invention.

In another embodiment of the present invention, the antenna device 20 also includes at least one filter 218 connected to the first ground layer 215 and the second ground layer 217, as shown in FIG. 10. The filter 218 may be a capacitor, an inductor, a bandpass filter, a low-pass filter, or a high-pass filter.

The above disclosures are only the preferred embodiments of the present invention, and are not to be used to limit the scope of the present invention. All equivalent variations and modifications on the basis of shapes, structures, features and spirits described in claims of the present invention should be included in the claims of the present invention.

What is claimed is:

1. An antenna device capable of generating specific radiation pattern, comprising:

a circuit board, comprising a ground layer on its top surface, with a coplanar clearance area having no ground region, at least one signal feeding line disposed in the clearance area, wherein the clearance area is not disposed on an edge of the circuit board, and a shortest distance from an edge of the clearance area to a nearest edge of the circuit board is greater than 1/10 of a smallest width of the circuit board; and at least one chip antenna, comprising a substrate extending vertically from the top surface of the circuit board such that a height of the substrate is greater than a length and a width of the substrate, at least one resonance unit including at least one conductive trace or at least one conductive layer that is spirally disposed on a surface of the substrate or within the substrate, and a conducting layer covering a bottom surface area of the substrate which connects the resonance unit and the signal feeding line;

wherein the chip antenna is disposed in the clearance area and the resonance unit is connected to the at least one signal feeding line, and wherein the chip antenna is spaced from the edge of the circuit board.

2. The antenna device of claim 1, wherein the resonance unit comprises a first resonance element and a second resonance element, and the two resonance elements are connected via a tuning element.

3. The antenna device of claim 2, wherein the tuning element is a capacitor, an inductor, a resistor, or an LC resonant circuit.

* * * * *